US006216786B1

(12) United States Patent
Griffin et al.

(10) Patent No.: US 6,216,786 B1
(45) Date of Patent: Apr. 17, 2001

(54) METHOD FOR FORMING A FRACTURE IN A VISCOUS OIL, SUBTERRANEAN FORMATION

(75) Inventors: Lawrence G. Griffin, Anchorage, AK (US); Carl T. Montgomery, Plano, TX (US)

(73) Assignee: Atlantic Richfield Company, Chicago, IL (US)

( * ) Notice: Subject to any disclaimer, the term of this patent is extended or adjusted under 35 U.S.C. 154(b) by 0 days.

(21) Appl. No.: 09/092,886

(22) Filed: Jun. 8, 1998

(51) Int. Cl.[7] ..... E21B 43/17; E21B 43/26

(52) U.S. Cl. ..... 166/308; 166/250.1; 166/280; 166/281; 166/305.1; 73/152.51

(58) Field of Search ..... 166/250.1, 308, 166/280, 281, 303, 305.1, 307, 306; 73/152.29, 152.51, 152.55

(56) References Cited

U.S. PATENT DOCUMENTS

| | | | | |
|---|---|---|---|---|
| 3,330,353 | * | 7/1967 | Flohr | 166/303 X |
| 3,349,849 | * | 10/1967 | Closmann | 166/303 X |
| 3,378,074 | * | 4/1968 | Kiel | 166/308 |
| 3,552,494 | * | 1/1971 | Kiel | 507/922 |
| 3,601,198 | * | 8/1971 | Ahearn | 507/232 |
| 3,710,865 | * | 1/1973 | Kiel | 166/308 |
| 3,713,915 | * | 1/1973 | Fast | 149/2 |
| 3,730,276 | * | 5/1973 | Land | 166/308 X |
| 3,739,852 | * | 6/1973 | Woods et al. | 166/303 |
| 3,822,746 | * | 7/1974 | Gogarty | 166/252 |
| 3,858,658 | * | 1/1975 | Strubhar et al. | 166/308 |
| 3,896,877 | * | 7/1975 | Vogt, Jr. et al. | 166/250 |
| 4,141,415 | * | 2/1979 | Wu et al. | 166/252 |
| 4,217,231 | * | 8/1980 | King | 252/8.55 |
| 4,393,933 | * | 7/1983 | Nolte et al. | 166/308 X |
| 4,398,416 | * | 8/1983 | Nolte | 73/155 |
| 4,509,598 | * | 4/1985 | Earl et al. | 166/308 |
| 4,749,038 | * | 6/1988 | Shelley | 166/250 |
| 4,836,280 | * | 6/1989 | Soliman | 166/250 |
| 4,887,671 | * | 12/1989 | Stevens, Jr. | 166/308 |
| 4,917,188 | * | 4/1990 | Fitzpatrick, Jr. | 166/278 |
| 5,005,643 | * | 4/1991 | Soliman et al. | 166/250 |
| 5,005,648 | * | 4/1991 | Friedman et al. | 166/295 |
| 5,050,674 | * | 9/1991 | Soliman et al. | 166/250 |
| 5,070,457 | * | 12/1991 | Poulsen | 364/420 |
| 5,074,359 | * | 12/1991 | Schmidt | 166/308 X |
| 5,143,156 | * | 9/1992 | Bromley | 166/303 X |
| 5,207,271 | * | 5/1993 | Sanchez et al. | 166/303 X |
| 5,271,463 | * | 12/1993 | Jennings, Jr. | 166/271 |
| 5,305,211 | * | 4/1994 | Soliman | 364/422 |
| 5,421,412 | * | 6/1995 | Kelly et al. | 166/300 |
| 5,437,331 | * | 8/1995 | Gupta et al. | 166/300 |
| 5,441,340 | * | 8/1995 | Cedillo et al. | 366/2 |
| 5,497,658 | | 3/1996 | Fletcher et al. | 73/151 |
| 5,497,831 | * | 3/1996 | Hainey et al. | 166/308 |
| 5,558,161 | * | 9/1996 | Vitthal et al. | 166/280 |
| 5,595,248 | * | 1/1997 | Scott, III | 166/250.1 |
| 5,883,053 | * | 3/1999 | Tudor | 507/102 |
| 5,921,317 | * | 7/1999 | Dewprashad et al. | 166/208 |
| 5,948,733 | * | 9/1999 | Cawiezel et al. | 507/212 |
| 5,964,295 | * | 10/1999 | Brown et al. | 166/308 |

OTHER PUBLICATIONS

"Propped Fracturing as a Tool for Sand Control and Reservoir Management"; Bale et al.; SPE24992; Cannes, France; Nov. 16–18, 1992.

TSO Frac–Packing: Pilot Evaluation to Full–Scale Operation in a Shallow Unconsolidated Heavy Oil Reservoir; Putra et al; SPE 37533; Bakersfield, CA. Feb. 10–12, 1997.

A Systematic Approach to Developing Engineering Data for Fracturing Poorly Consolidated Formations; Upchurch et al; SPE 38588; San Antonio, TX; Oct. 5–8, 1997.

* cited by examiner

*Primary Examiner*—Eileen D. Lillis
*Assistant Examiner*—Jong-Suk Lee
(74) *Attorney, Agent, or Firm*—Drude Faulconer

(57) ABSTRACT

A method for forming a fracture in a viscous oil subterranean formation wherein a data-fracturing operation is carried out to first determine the "leak-off" rate for the formation and then the formation is fractured with a slurry wherein the liquid from the slurry will leak into the formation at the predetermined leak-off rate to thereby provide fractures of a desired length necessary in sand control or the like. In accordance with the present invention, the formation is treated before both the data-fracturing operation and the subsequent fracturing operation with a treatment fluid (e.g. diesel) which will interact with the viscous oil to reduce its viscosity so that the fracturing fluid can readily leak into the formation.

11 Claims, No Drawings

METHOD FOR FORMING A FRACTURE IN A VISCOUS OIL, SUBTERRANEAN FORMATION

DESCRIPTION

1. Technical Field

The present invention relates to a method for forming a fracture in a viscous oil bearing, subterranean formation and in one of its aspects relates to a method for inducing a tip screen-out (TSO) fracture in a viscous oil formation which includes treating the formation to decrease the viscosity of the oil as part of the fracturing operation.

2. Background

In producing hydrocarbons from unconsolidated or weakly-consolidated formations, the production of sand along with the hydrocarbons has long been a problem. One of the more commonly used techniques for controlling this sand production is to "gravel-pack" the well adjacent the producing formation. However, installing a proper gravel pack in a particular well can be difficult and expensive and, in some cases, may actually decrease the productivity of the well by increasing the "completion skin" (i.e. damage to the near-wellbore caused by drilling and/or completion of the well).

Recently, it has been proposed to control sand production from certain formation through the use of hydraulic fractures alone, e.g. see U.S. Pat. No. 5,497,658, issued Mar. 12, 1996 to Fletcher et al. wherein a specific fracture is induced in a formation to control the production of sand from that formation. The fracture is sized to have the minimum length necessary to alleviate production of sand from the formation even when the formation is produced at higher-than-normal, draw-down pressures.

Another technique which uses hydraulic fracturing for controlling the production of sand from a particular formation is disclosed in "TSO Frac-Packing: Pilot Evaluation to Full-Scale Operations in A Shallow Unconsolidated Heavy Oil Reservoir" , P. H. Putra et al, SPE 37533, Feb. 10–12, 1997, Bakersfield, Calif. In this method, a fracture is initiated and then deliberately "screened-out" at its tip to thereby limit its growth (i.e. its length) away from the wellbore. Once the fracture has experienced a tip screen-out (TSO), the continued injection of the fracturing fluid, which contains resin-coated proppants, now causes the fracture to widen substantially. The well is then shut-in and the resin on the proppants is allowed to set to form an "external gravel pack" for controlling sand production from the fractured formation.

In hydraulic fracturing operations especially those used to control sand production, such as those briefly described above, the fracturing operation must be specifically designed and engineered for the particular formation to be fractured. In order to do this, certain parameters of the formation must be known in advance. One such parameter is the "leak-off rate" for the formation (i.e. the rate at which fluid will "leak-off" from the fracturing slurry into the formation). This leak-off rate is extremely important, especially in designing TSO fracturing operations since the length of the fracture into the formation is controlled by deliberately allowing fluid (i.e. liquid) from the fracturing fluid to leak-out into the formation at the predetermined rate. This allows the fracture to grow to its predicted length before sufficient liquid leaks into the formation whereupon the proppants in the slurry will now form a "sand-bridge" at the tip of the fracture which, in turn, blocks further flow of slurry past that point. Since the length of the fracture can now no longer grow outward from the wellbore, it will be widened instead by the continued injection of fracturing slurry. Once all of the resin-coated proppants have been placed, the resin is allowed to set to form an external gravel pack around the well casing.

One known way for determining the leak-off rate of a formation is a process known as "data-fracturing" (DF). In this process, the formation is first fractured using only the liquid which is to be used in the subsequent fracturing operation. That is, no proppant material is used in the DF operation. An interval of the wellbore adjacent the formation is isolated and the fracturing liquid is injected into the formation to initiate the fracture. The wellbore is then shut-in and the pressure is allowed to decay (i.e. the fracturing fluid leaks-off into the formation allowing the fracture to close). The time it takes for the fracture to close after the well is shut-in is recorded and, as will be understood in the art, provides the data necessary for determining the leak-off rate for that fluid into that formation.

Data-fracturing (DF) operations and the subsequent fracturing operations based on data gathered from DF operations work well where the fractured formation contains light hydrocarbons and/or gas. However, in formations containing viscous hydrocarbons (i.e. oils having a viscosity of above about 17 centipoises), it is difficult, if possible at all, (a) to use DF or similar operations for establishing accurate leak-off rates or (b) to design specific fracturing operations for that formation based on leak-off rates of the fracturing fluid. This is especially true where TSO fracturing operations are to be used to control sand production in viscous formations.

It is believed that the difficulty in obtaining accurate leak-off rates and in designing fracturing operation for viscous oil formations lies in the fact that the viscous oil impedes the flow (i.e. leak-off) of fracturing fluid into the formation. This results in basically useless leak-off rates from standard DF operations and, further actually prevents the fluid from the fracturing slurry from leaking off at the rate necessary to screen-out the proppants during a subsequent TSO fracturing operation. Since such fractures must be precisely engineered to insure good results, it can be seen that the need exists for improving the accuracy of the leak-off data from DF or similar operations and for designing the subsequent fracturing operations when the operations are to be carried out in viscous oil formations.

SUMMARY OF THE INVENTION

The present invention provides a method for forming a fracture in a viscous oil subterranean formation wherein a data-fracturing operation is carried out to first determine the "leak-off" rate for the formation and then the formation is fractured with a slurry wherein the liquid from the slurry will leak into the formation at the predetermined leak-off rate to thereby provide fractures of a desired length necessary in sand control or the like. In accordance with the present invention, the formation is treated before both the data-fracturing operation and the subsequent fracturing operation with a method treatment fluid which will interact with the viscous oil to reduce its viscosity so that the fracturing fluid can readily leak into the formation.

Basically, the present invention provides a wherein the formation is treated to reduce the viscosity of the oil, after which the data-fracturing operation is carried out to establish the leak-off rate of the formation. The formation is again treated to reduce the viscosity of the oil before it is fractured with a fracturing slurry which, in turn, is designed to leak-off into the formation at basically the same leak-off rate as established from the data-fracturing operation.

More specifically, in carrying out the present invention, an interval of the wellbore is isolated adjacent the viscous oil formation to be fractured (i.e. a formation containing oil having a viscosity of about 17 centipoises or greater). A treating fluid, selected from the group of diesel, alcohol, carbon dioxide, miscible hydrocarbon gases, etc., is injected through the isolated interval and into the formation to interact with the viscous oil to reduce its viscosity. The treated formation is then fractured by injecting a fracturing fluid which contains no proppants into the formation to form a data-fracture therein. The wellbore is shut-in and the pressure in the data-fracture is allowed to decay which, in turn, allows the fracture to close. The time it takes for the pressure to decay after the wellbore is shut-in provides the data necessary to establish the leak-off rate for the fracturing fluid into the formation.

Once the leak-off rate is established, additional treatment fluid is injected into the formation to interact with the viscous oil to reduce its viscosity before a fracturing slurry (e.g. fracturing fluid used in the data-fracturing operation plus proppant such as sand, ceramic, or resin-coated articles) is injected into the formation behind the treatment fluid to form a desired fracture in the formation. The liquid from the slurry will leak off into the formation at the predetermined leak-off rate as the fracture is being formed so that the proppant will screen out at the tip of the fracture after the fracture has reached a desired length to thereby prevent further growth of the fracture into the formation. The wellbore is then shut-in and the fracture is allowed to close on the proppant yielding a highly-permeable mass in the fracture.

By treating the formation to reduce the viscous oil prior to the data fracturing operation, the fracturing fluid can leak into the formation without any substantial resistance from the oil thereby providing an accurate leak-off rate for that fluid into the formation. Then, by treating the formation before carrying out the subsequent fracturing operation, the leak-off rate of the liquid from the fracturing slurry used in the subsequent operation will be substantially the same as that established from the data-fracturing operation since the conditions (i.e. the reduce viscosity of the oil) within formation are substantially the same during both fracturing operations.

BEST KNOWN MODE FOR CARRYING OUT THE INVENTION

In designing and carrying out fracturing operations (especially those designed to control sand production), it is vitally important to know certain parameters of the formation to be fractured. One very important parameter is the "leak-off" rate of the formation. This leak-off rate is typically determined by first carrying out a data-fracturing operation (DF) wherein the formation is first fractured with the selected fracturing fluid except it does not contain proppant. The data-fracture is initiated and then the well is shut-in and the time it takes for the fracture to close is recorded, from which the leak-off rate is established.

Where the DF operation is carried out in a light-hydrocarbon or gas-bearing formation, the fracturing fluid used in the DF operation can leak-off into the formation without any significant resistance from the formation fluids. However, where the formation contains viscous-oil (e.g. oil having a viscosity of about 17 centiposes or greater), the flow of the fracturing fluid into the formation may be significantly impeded by the viscous oil in the formation. Further, in subsequent operations where the formation is to be fractured in a manner necessary to accomplish a specific objective (e.g. to control sand production and stimulate oil production), the viscous oil prevents the liquid from leaking from the fracturing slurry into the formation at a predictable rate, if at all. This makes the designing and carrying out a specific fracturing operation (e.g. TSO fracturing) difficult, if possible at all The present invention provides a method for fracturing a viscous oil formation especially where it is vital that a predictable leak-off rate be established, e.g. fracturing for controlling sand production and stimulating oil production from the formation. A DF or similar operation is first carried out to determine the leak-off rate for the formation but, in the present invention, the formation is treated prior to the DF operation to reduce the viscosity of the oil therein so that the fracturing fluid can readily leak into the formation thereby providing reliable data from which the subsequent fracturing operation can be designed.

The DF operation is carried out by isolating an interval of the wellbore adjacent the viscous-oil formation. A treatment fluid is then pumped down the wellbore into the formation. The treatment fluid may be selected from various fluids or solvents which will interact with the viscous oil in the formation substantially to reduce its viscosity. Such fluids include diesel, alcohol, carbon dioxide, miscible gases such propane, butane, etc.

The treatment fluid (e.g. diesel) is followed by a slug of the fracturing fluid which is to be used in the subsequent fracturing operation except the fracturing fluid does not contain any proppant. For example, a typical fracturing fluid for the DF operation might be comprised of hydroxylethyl cellulose (HEC) added to a 3% potassium chloride, brine solution in a ratio of about 50 pounds of HEC per 1000 gallons of brine solution. The fracturing fluid displaces the treatment fluid and reduced-viscosity oil into the formation ahead of it as a fracture is being formed in the formation.

Once the desired volume of fracturing fluid (e.g. a volume equal to or slightly less than the volume of the treatment fluid) has been pumped into the wellbore, additional treatment fluid, e.g. diesel, can be pumped down the wellbore to flush any remaining fracturing fluid from the wellbore into the formation. After the data fracture has been formed and all of the fracturing fluid has been placed, the wellbore is shut-in and the fracturing fluid is allowed to leak from the fracture into the formation.

Since the treatment fluid has reduced the viscosity of the viscous oil in the formation around the fracture, the fracturing fluid can now readily leak into the formation without any substantial resistance from the oil. The time which it takes for the fracturing fluid to leak from the fracture into the formation is then recorded (i.e. time it takes for the fracture pressure to decay and the fracture to close). As will be understood, this data is then used to establish the leak-off rate for the formation which, in turn, can now be used to design a subsequent fracturing operation such as one used for controlling the production of sand from the formation and to stimulate oil production (e.g. TSO fracturing operation).

That is, once a reliable leak-off rate has been established from the DF operation, the subsequent fracturing operation can now be designed wherein the fracture which will experience TSO at a predictable point into the formation thereby producing a fracture of a desired length. However, it must be remembered that the leak-off rate used in designing the subsequent fracturing operation was established from data taken only after the formation had been treated with a treatment fluid which substantially reduced the viscosity of the oil around the data-fracture. Accordingly, for the subsequent fracturing operation to be successful, the formation must again be treated with basically the same treatment fluid to reduce the viscosity of the oil around the fracture to be formed before injecting the fracturing slurry. This is necessary in order to insure that the leak-off rate of the slurry will substantially match the leak-off rate based on the data from the DF operation.

Therefore, in carrying out the subsequent fracturing operation of present invention, additional treatment fluid, e.g. diesel, is injected down the wellbore and into the formation before the fracturing slurry is injected. The volume of treatment fluid is equal to at least (a) the predicted volume of liquid which will leak-off from the fracturing slurry as desired, designed TSO fracture is formed in the formation, e.g. two times the pad volume used to initiate the fracture or (b) a wellbore volume, whichever is the greater. It is important that sufficient treatment fluid is injected to adequately reduce the viscosity of the viscous-oil in the eventual, leak-off region of the formation around the fracture.

Next, a fracturing slurry is pumped down the wellbore behind the treatment fluid. The fracturing fluid will have basically the same composition as that used in the DF operation except it will also include proppant such as sand, ceramic, or resin-coated particles. The fracturing slurry enters the formation forcing the treatment fluid ahead of it as the fracture is being formed.

Again, the treatment fluid will interact with viscous oil to reduce the viscosity of the oil around the fracture so that the liquid in the fracturing slurry can leak into the formation at the rate predicted from the DF operation. As the fracture grows to its desired length, fluid from the slurry at the forward tip of the fracture will have leaked off to the extent that the proppants therein will screen out to form a bridge which, in turn, blocks further flow of fracturing fluid through the fracture and into the formation beyond that point. Continued pumping of the slurry will now cause the fracture to widen and become filled with proppants from the slurry. Once the desired volume of slurry has been pumped, the wellbore can be flushed with additional treatment fluid, e.g. diesel, or other flushing fluid, e.g. brine, to force any remaining slurry from the wellbore and into the formation.

The well is then shut-in and the fracture is allowed to close on the proppant to thereby provide a permeable mass (i.e. external gravel pack) within the fracture, casing perforations, and within the relatively small "halo" that is believed to form around the well casing at the conclusion of the fracturing operation due to the compression of the formation at that point.

By treating a viscous-oil formation to reduce the viscosity of the oil before both carrying out a DF or other similar fracturing operation and the subsequent fracturing operation based on data from the DF operation, it can be seen that more predictable fracturing operations can be performed.

What is claimed is:

1. A method for forming a fracture in a viscous oil, subterranean formation, said method comprising:

treating said formation with a treatment fluid to reduce the viscosity of the viscous oil;

carrying out a data fracturing operation after said formation has been treated to reduce the viscosity of said viscous oil to thereby establish a leak-off rate for a fracturing fluid to be used in forming said fracture;

treating said formation with said treatment fluid before forming said fracture; and forming said fracture in said formation with a fracturing slurry designed to leak-off at said leak-off rate.

2. The method of claim 1 wherein said viscous oil has a viscosity of about 17 centipoises or greater.

3. The method of claim 1 wherein said treatment fluid is selected from the group consisting of diesel, alcohol, carbon dioxide, and miscible hydrocarbon gases.

4. A method for forming a fracture having a tip in a viscous oil, subterranean formation having a wellbore extending therein, said method comprising:

isolating an interval of said wellbore adjacent said formation;

injecting a treatment fluid into said formation through said isolated interval, said treatment fluid interacting with said viscous oil to reduce the viscosity thereof;

injecting a fracturing fluid into said formation through said isolated interval to form a data-fracture in said formation;

shutting-in said wellbore and allowing the pressure within said data-fracture to decay and the fracture to close;

recording the time for the pressure to decay after a wellbore is shut-in to thereby establish a leak-off rate for said fracturing fluid;

injecting additional said treatment fluid into said formation through said isolated interval, said treatment fluid again interacting with said viscous oil to reduce the viscosity thereof; and injecting a slurry of said fracturing fluid and proppant material into said formation to form said fracture.

5. The method of claim 4 wherein said viscous oil has a viscosity of about 17 centipoises or greater.

6. The method of claim 5 wherein said fracturing fluid from said fracturing slurry leaks into said formation at said leak-off rate whereby said proppant material screen out at said tip of the fracture after said fracture reaches a desired length to thereby prevent further growth of the fracture into said formation.

7. The method of claim 6 wherein said proppant material is comprised of resin-coated proppants.

8. The method of claim 7 including:

shutting-in said wellbore after said fracture has been formed in said formation to allow the fracture to close on said proppant to thereby form a permeable mass in said fracture.

9. The method of claim 4 wherein said treatment fluid is selected from the group consisting of diesel, alcohol, carbon dioxide, and miscible hydrocarbon gases.

10. A method for establishing a leak-off rate of a fluid into a subterranean formation which contains viscous oil and which has a wellbore extending therein, said method comprising:

isolating an interval of said wellbore adjacent said formation;

injecting a treatment fluid into said formation through said isolated interval, said treatment fluid adapted to reduce the viscosity of said viscous oil in said formation;

injecting a fracturing fluid into said formation through said isolated interval to form a data-fracture in said formation;

shutting-in said wellbore and allowing the pressure within said data-fracture to decay; and recording the time for the pressure to decay and said data-fracture to close after the wellbore is shut-in to thereby establish said leak-off rate for said fracturing fluid.

11. The method of claim 10 wherein said treatment fluid is selected from the group consisting of diesel, alcohol, carbon dioxide, and miscible hydrocarbon gases.

* * * * *